United States Patent [19]

Burger

[11] 4,104,739

[45] Aug. 8, 1978

[54] HOOK-ON NECKTIE CONVERSION KIT

[75] Inventor: John P. Burger, Mitchell, Ind.

[73] Assignee: The Raymond Lee Organization, Inc., New York, N.Y.

[21] Appl. No.: 784,972

[22] Filed: Apr. 6, 1977

[51] Int. Cl.[2] ..... A41D 25/16

[52] U.S. Cl. ..... 2/155

[58] Field of Search ..... 2/155, 150; 24/204, 24/DIG. 11, 265 H, 265 R, 201 HE, 225

[56] References Cited

U.S. PATENT DOCUMENTS

| | | | |
|---|---|---|---|
| 1,704,422 | 3/1929 | Belunes | 24/50 |
| 1,897,333 | 2/1933 | Ressequie | 2/155 X |
| 3,715,783 | 2/1973 | Parks et al. | 24/265 R |

*Primary Examiner*—Alfred R. Guest

*Attorney, Agent, or Firm*—Howard I. Podell

[57] ABSTRACT

A kit for converting a conventional necktie to a pre-knotted tie that is attached to the neck of a wearer by detachable hook and eye fasteners. The kit includes two flexible strips, each fitted with one mating section of a detachable fastener and each formed on its underside with an adhesive coating so that a necktie, properly knotted in place about the neck of a user may be cut along the neck strap section and each of the strips then fastened to the opposed cut ends of the neck strap. The kit also includes a disc coated on both sides with a self-adhering adhesive which may be fastened in place under a folded knot section of the tie to hold the knot section in shape.

1 Claim, 7 Drawing Figures

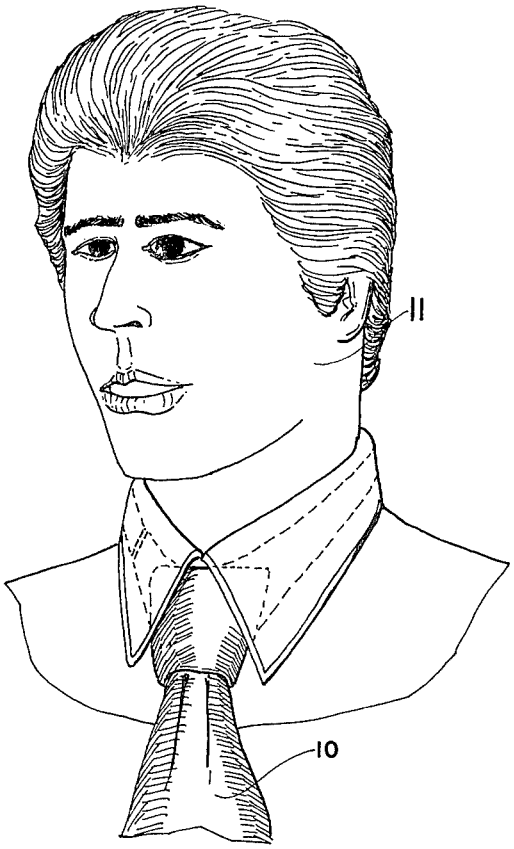
FIG. 1
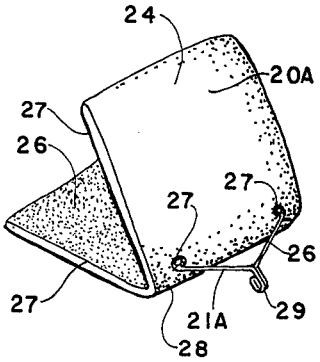
FIG. 5
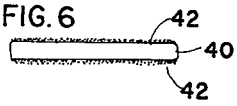
FIG. 6
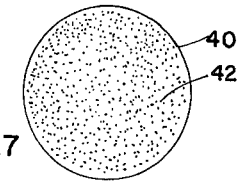
FIG. 7
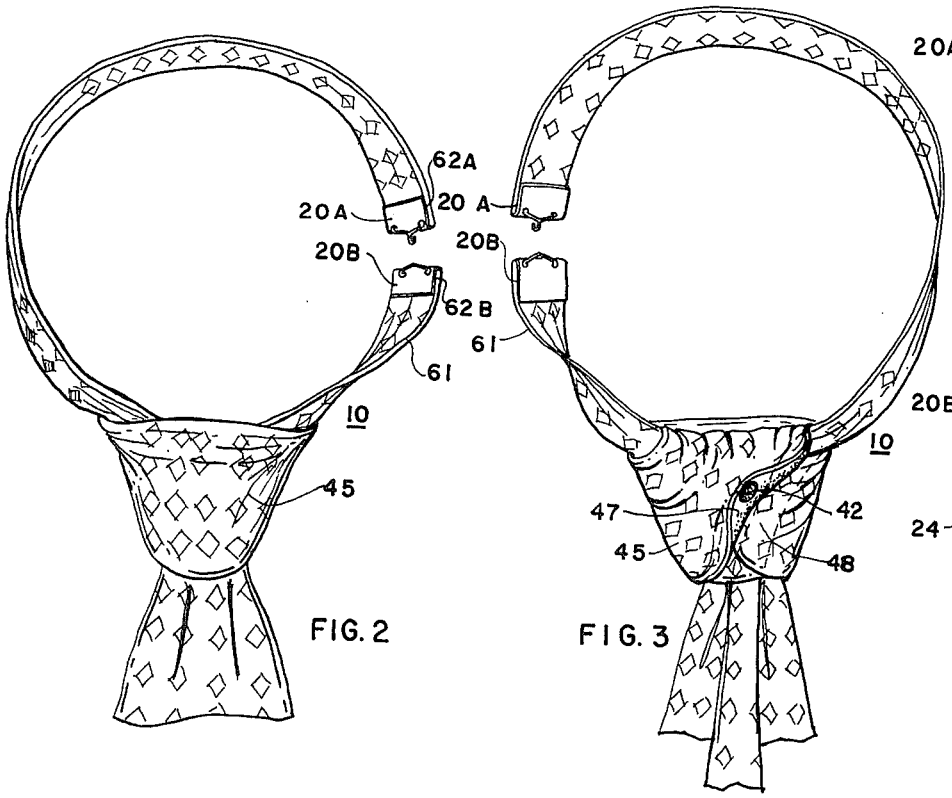
FIG. 2
FIG. 3
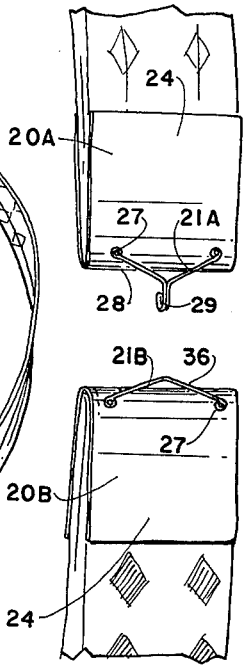
FIG. 4

HOOK-ON NECKTIE CONVERSION KIT

SUMMARY OF THE INVENTION

My invention is a kit for converting a conventional necktie to a pre-knotted tie that is attached to the neck of a wearer by detachable hook and eye fasteners. The kit includes two flexible strips, each fitted with one mating section of a detachable fastener and each formed on its underside with an adhesive coating so that a necktie, properly knotted in place about the neck of a wearer may be cut along the neck strap section and each of the strips then fastened to the opposed cut ends of the neck strap. The kit also includes a disc coated on both sides with a self-adhering adhesive which may be fastened in place under a folded knot section of the tie to hold the knot section in place.

By means of my invention, a person may convert a conventional necktie to a detachable pre-knotted tie with the neck band set for his particular size neck and with the tie pre-knotted to his particular style.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention in use;

FIG. 2 is a front view of the assembled necktie;

FIG. 3 is a rear view of the assembled necktie;

FIG. 4 is a detail exploded view of the necktie strap and fasteners;

FIG. 5 is a perspective view of a necktie strap fastener;

FIG. 6 is a sectional view of a knot disc; and

FIG. 7 is a plan view of a knot disc.

DESCRIPTION OF THE PREFERRED EMBODIMENT

Turning now descriptively to the drawings, in which similar reference characters denote similar elements throughout the several views, FIG. 1 illustrates a user 11 wearing a necktie 10 that has been pre-knotted, using the kit of the invention.

The kit includes two strap fastener units 20A and 20B as shown in FIGS. 2–5 which are of similar construction except for the mating fastener units 21A and 21B respectively. Each strap fastener 20A, 20B is formed of a flexible rectangular shape of flexible material 24 bent as a U-shaped section, with an adhesive coating 26 applied as a backing to the facing undersurfaces 27 of each fastener. A male fastener 21A in the form of a closed loop 26 of wire is fastened through two through holes 27 in strap fastener 20A adjacent the fold line 28 with a hook 29 fixed to loop 26 of a size to attach about a closed loop 36 fastened through two through holes 27 in fastener 20B, that serves as fastener 21B.

The kit also includes a flat disc 40 of flexible material coated on both opposed surfaces with an adhesive backing 42.

To use the kit, the user first knots a conventional necktie about his neck to suit his taste and fit. The strap section 61 is then cut and the tie removed from the wearer's person. An additional section of material may then be removed from the strap section 61 adjacent the cut line so as to shorten the strap to compensate for the installed length when assembled. A fastener 20A is then bonded by means of the adhesive backing to one end 62A of the cut necktie strap section 61 and the other fastener 20B similarly bonded to the other end 62B of the cut necktie strap section 61 and the assembled unit reinstalled about the neck of the wearer by fastening hook 29 to loop 36.

Each fastener strap 20A, 20B is bonded by adhesive backing to the opposed flat surfaces of the respective end section of the necktie strap to form a secure and permanent bond.

In order to hold the knot section 45 in fixed relation to the necktie strap section 61, disc 40 is inserted in the rear of the knot, as shown in FIG. 3 between adjacent layers 47, 48 of the knot 45 which are then pressed together to fix layers 47, 48 of the knot in a bonded joint and prevent the knot section from sliding and or from loosening.

While the invention has been illustrated in terms of a necktie tied with a four-in-hand knot, it is equally useful for permanently forming as a bow tie or other tie knot.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A kit for preforming a conventional necktie to a pre-knotted necktie, comprising a pair of flexible fastener units, each of which is formed of a flat section of flexible material of U-shape in cross-section, with an adhesive coating mounted as a backing to the opposed undersurfaces of the material, with each fastener of a size to fit about the end section of a cut neck strap section of a conventional necktie, with said fastener units each fitted with one half of a mating detachable fastener assembly, together with a flat strip of flexible material, coated on both surfaces with adhesive material of a size to fit between two layers of a necktie knot so as to hold the knot fixed when the said two layers are each bonded to a surface of the strip by means of the said adhesive material.

* * * * *